US010231527B2

(12) United States Patent
Davis

(10) Patent No.: US 10,231,527 B2
(45) Date of Patent: Mar. 19, 2019

(54) SNAPPY COLOR CAPS

(71) Applicant: Jennifer D. Davis, Burbank, CA (US)

(72) Inventor: Jennifer D. Davis, Burbank, CA (US)

( * ) Notice: Subject to any disclaimer, the term of this patent is extended or adjusted under 35 U.S.C. 154(b) by 0 days.

(21) Appl. No.: 15/397,343

(22) Filed: Jan. 3, 2017

(65) Prior Publication Data

US 2017/0188683 A1 Jul. 6, 2017

Related U.S. Application Data

(60) Provisional application No. 62/274,029, filed on Dec. 31, 2015.

(51) Int. Cl.
*A45D 29/00* (2006.01)
*A41D 13/08* (2006.01)
*A41D 19/015* (2006.01)

(52) U.S. Cl.
CPC ..... *A45D 29/00* (2013.01); *A41D 13/087* (2013.01); *A41D 19/01511* (2013.01); *A45D 2029/008* (2013.01)

(58) Field of Classification Search
CPC ..... A45D 29/00; A45D 2029/008; A41D 19/01517; A41D 19/01511; A41D 13/087
USPC ..... 132/285
See application file for complete search history.

(56) References Cited

U.S. PATENT DOCUMENTS 1,273,256 A * 7/1918 Manning ..... A41D 13/087 2/21
2,039,505 A * 5/1936 Vollmer ..... A61F 13/105 2/21
3,191,824 A * 6/1965 Burr ..... A41D 13/087 2/21
3,386,104 A * 6/1968 Casey ..... A41D 19/01517 2/16
4,960,138 A * 10/1990 Kling ..... A45D 29/00 132/73
5,031,608 A * 7/1991 Weinstein ..... A45D 29/00 128/879
5,085,234 A * 2/1992 Silverman ..... A45D 29/00 132/285
5,954,245 A * 9/1999 Kluesner ..... D05B 91/04 2/21
6,032,290 A * 3/2000 Lucas ..... A41D 19/00 2/159
6,457,182 B1 * 10/2002 Szczesuil ..... A41D 19/01511 2/16
6,470,832 B1 * 10/2002 Peacock ..... A01K 13/007 119/850
6,581,212 B1 * 6/2003 Andresen ..... A41D 19/01511 139/425 R
6,536,444 B1 † 12/2003 Chung
6,662,807 B2 † 12/2003 Meinschewnk
(Continued)

*Primary Examiner* — Tatiana L Nobrega
*Assistant Examiner* — Jennifer F Gill
(74) *Attorney, Agent, or Firm* — The Iwashko Law Firm, PLLC; Lev Ivan Gabriel Iwashko

(57) ABSTRACT

A nail covering for protecting one or more fingers or toenails from the harmful effects of dust and dirt includes a thin sheet of silicone, shaped and dimensioned to cover the nail. In a preferred embodiment, the thin sheet of silicone is shaped and dimensioned to cover the nail but not any surrounding flesh. In another preferred embodiment, the thin sheet of silicone has an adhesive backing for attaching the thin sheet of silicone to the nail.

4 Claims, 2 Drawing Sheets

(56) References Cited

U.S. PATENT DOCUMENTS

| | | | | |
|---|---|---|---|---|
| 6,726,068 | B2 † | 4/2004 | Miller | |
| 7,895,671 | B2 † | 3/2011 | Salomon | |
| D695,003 | S * | 12/2013 | Lee | D3/29 |
| 2001/0001883 | A1 † | 5/2001 | Wanzenried | |
| 2005/0166297 | A1 † | 8/2005 | Schukraft | |
| 2008/0076980 | A1 * | 3/2008 | Hoarau | A61B 5/14552 600/310 |
| 2011/0108045 | A1 * | 5/2011 | Racz | A45D 29/00 132/73 |
| 2012/0222186 | A1 * | 9/2012 | Vena | A41D 13/087 2/21 |
| 2014/0137304 | A1 * | 5/2014 | Katz | A41D 19/01505 2/16 |

* cited by examiner
† cited by third party

SNAPPY COLOR CAPS

CROSS REFERENCE TO RELATED APPLICATIONS

This application claims priority to and the benefits of the provisional patent application No. "62/274,029" titled "Snappy Color Caps", filed in United States Patent and Trademark Office on "Dec. 31, 2015". The specification of the above referenced patent application is incorporated herein by reference in its entirety

FEDERALLY SPONSORED RESEARCH AND DEVELOPMENT

Not applicable.

MICROFICHE

Not applicable

BACKGROUND OF THE INVENTION (1) Field of the Invention

This invention relates to the personal health and appearance of the fingernails. The invention is more particularly related to the care and appearance of the fingernails. The invention is even more directly related to a method and apparatus for the safe and convenient application of protective cover to the fingernails. It includes a method for protecting fingernail from injury or any other wounds and at the same time provides ventilation to the injured fingernails.

(2) Background of the Invention

Heretofore, it was known in prior art to provide finger and toenail protectors. Some previously recognized problems were that nails were exposed to breaking, chipping, dirt, etc. when the nails were exposed to household chores and trying to dry after a manicure etc. But none specifically addressed the protection of injured nails and toe fingers. It provides vented covering to the tip of the finger or toe nails.

For example, U.S. Pat. No. 4,180,058 directed to the method for treating pathological conditions of the nail, particularly onychomycosis. The method comprises the breaching the protective keratin of the nail to form an opening therein, placing a caustic-keratolytic agent in the opening to enlarge it, and treating the nail through the opening with topical therapeutic agents for the pathological condition being treated, for instance, an antifungal agent for onychomycosis. In addition, thick callouses and painful plantar warts can be removed with modifications of this method.

The use of fingernail protectors is known in the prior art. U.S. Pat. No. 5,121,760 describes a device for protecting the free edge of a fingernail. The device comprise continuous strip of flexible material that is either molded, pressed or stamped into an arcuate shape to conform to the shape of the tip of the fingernail. The guard is preferably manufactured from a thin layer of either transparent plastic (e.g. vinyl) or a reflective metallic foil. The guard is bonded to the wearer's nail by means of a commercially available adhesive commonly used with artificial nails. A decorative design may be applied to the nail guard (e.g. by means of either paint or a decal) to enhance the ornamental appearance thereof.

U.S. Pat. No. 5,540,243 discloses a finger protector which primary function is to maintain tactile sensitivity. This fingernail protector guard protect fingernails during the polish drying process and enable the polish to dry free of any dents, chips, tears or sheet marks. The fingernail protector is preferably lightweight and smooth.

It would therefore be desirable to provide a wearer with a low cost fingernail protector that may be easily bonded to a fingernail to preserve the appearance and also provide a vented cover that could be placed simply on the fingernail tips with protecting the tip against chipping, cracking and related damage.

It would also be desirable, but not required; that the fingernail and toe nails protector be provided with a decorative design by which to enhance the ornamental appearance of the nail to which said protector is bonded.

SUMMARY OF THE INVENTION

In the view of the foregoing disadvantages inherent in the known types of finger nails or a toe/fingertip cover now present in the prior art, the present invention provides an improved finger nails or a toe/fingertip cover. As such, the general purpose of the present invention, which will be described subsequently in greater detail, is to provide a new and improved finger nails or a toe/fingertip cover, which has all the advantages of the prior art and none of the disadvantages.

An object of the invention is to provide a fingernail or Toe/fingertip cover that includes a vented sleeve, shaped and dimensioned to cover a finger or toenail. The cover blocks the dirt and dust, thereby preventing the nails from getting dirty.

Another object of the present invention is to provide a fingernail or Toe/fingertip cover shaped and dimensioned to cover the nail but not any surrounding flesh.

Still another object of the present invention is to provide a fingernail or Toe/fingertip cover with an adhesive backing for attaching the cover to the nail.

Yet another object of the present invention is to provide a plurality of fingernail or Toe/fingertip cover including individual nail coverings of different sizes to cover different size nails.

A further object of the present invention to provide a fingernail or Toe/fingertip covers, that is made from vented Silicone Sleeve.

A further object of the present invention is to provide a fingernail or Toe/fingertip cover made from light weight Silicone sleeve, which is flexible enough to conform to irregularities and deviations from the average finger shape, resulting in a comfortable fit.

It is an object of the invention to provide improved elements and arrangements thereof in an apparatus for the purposes described which is inexpensive, safe, dependable and fully effective in accomplishing its intended purposes.

In this respect, before explaining at least one object of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural and logical changes may be made without departing from the spirit and scope of the present invention. The following detailed description is, therefore, not to be taken in a limiting sense, and the scope of the present invention is defined by the appended claims and their equivalents.

The nails are made from hard protein, which is called keratin. A protein is one of the building blocks which make up the body. The nails help protect the ends of the fingers and toes from trauma and also help us pick up small objects. For protecting the injured or wounded nails, a top covering is applied over the nails, which could be made from light weighted materials.

The finger/toe tip protective apparatus according to the present invention is designed to protect fingernails during the polish drying process and enable the polish to dry free of any dents, chips, tears or sheet marks. The fingernail protector is preferably lightweight and smooth.

Figure 1:
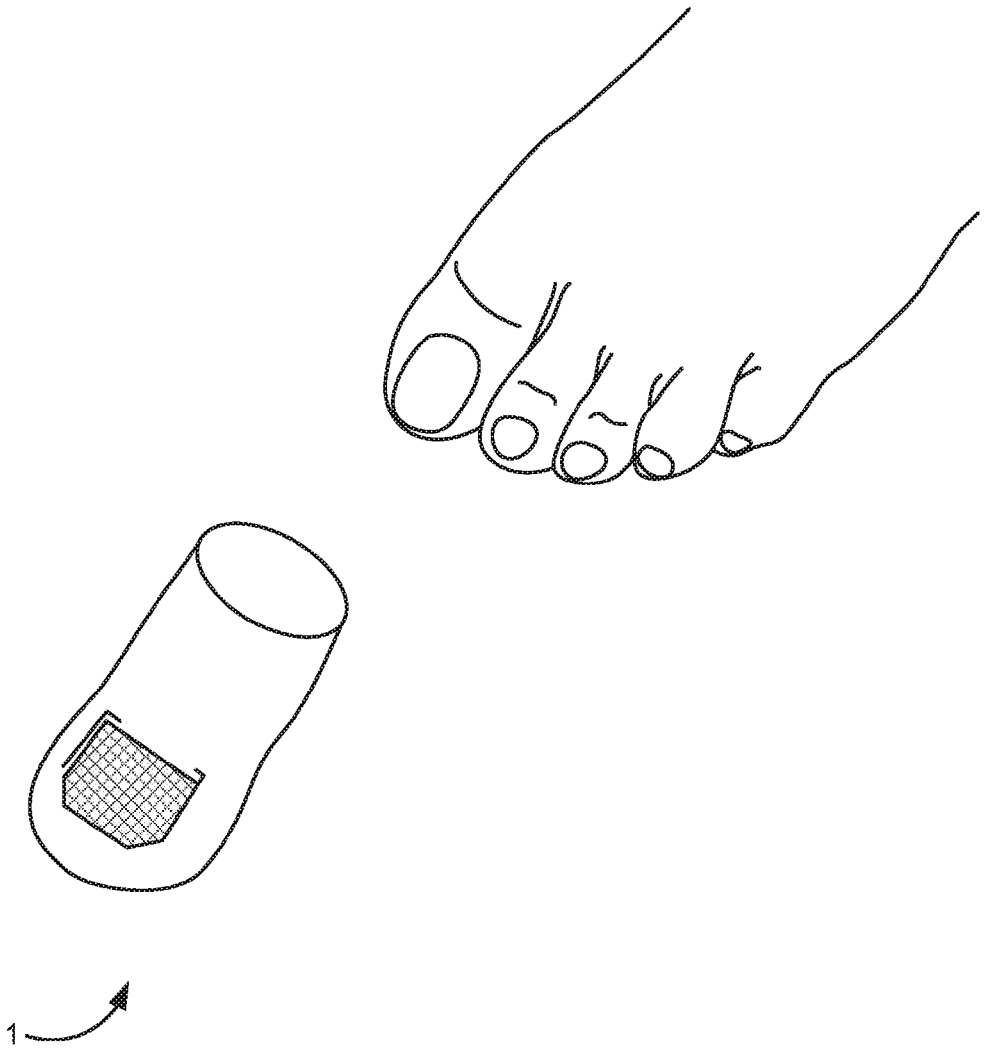
FIG. 1 illustrates a front view of a first embodiment of a finger/toe tip protective apparatus with a toe according to an embodiment herein.

Referring now to the drawings wherein like numerals represent like elements, FIG. 1 shows a finger/toe tip protective apparatus 1 with a toe according to the preferred embodiment of the present invention.

Figure 2:
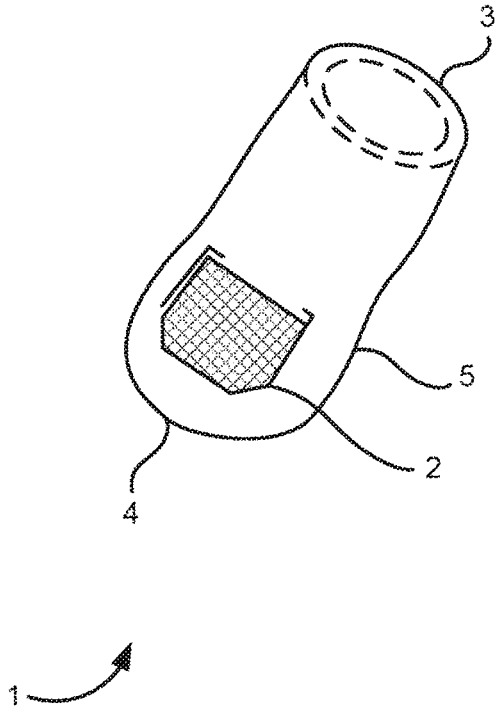
FIG. 2 illustrates a perspective view of the finger/toe tip protective apparatus according to an embodiment herein.

FIG. 2 illustrates the finger/toe tip protective apparatus 1 that includes a mesh 2, an open end 3, a closed end 4 and a sleeve 5. The sleeve 5 possesses an outer surface and an inner surface. The inner surface of the sleeve 5 has adhesive to affix thereto, which serves to fixedly attach to the nails properly without sliding.

The finger/toe tip protective apparatus 1 includes the sleeve 5, shaped and dimensioned to cover a nail such as a fingernail, thumbnail, or toenail (refer to FIG. 1). The sleeve 5 is a sheet of smooth light weight Silicone. In the shown preferred embodiment, the sleeve 5 is shaped and dimensioned to substantially cover the nail but not any surrounding flesh.

In a preferred embodiment, a plurality of finger/toe tip protective apparatus 1 includes individual finger/toe tip protective apparatus 1 of different sizes. For example, the finger/toe tip protective apparatus 1 for the thumb would be larger than the finger/toe tip protective apparatus 1 for the little finger.

In the illustrated embodiment, the Silicone sleeve 5 further defines a vented surface 2 of it, which keeps the nails in a healthy and protected condition. The apparatus could be easily removed from the nails. The finger/toe tip protective apparatus 1 is available in different colors, For example: White color of sleeve is used for medical purpose and for cosmetic industry it is decorated with the form of soft pastels with pretty little designs like flowers and other aesthetic signs.

It is to be understood that the above description is intended to be illustrative, and not restrictive. For example, the above-discussed embodiments may be used in combination with each other. Many other embodiments will be apparent to those of skill in the art upon reviewing the above description.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

What is claimed is:

1. A fingertip or toe tip protective apparatus to protect a fingertip or a toe tip of a user, the protective apparatus consisting of:

an imperforate silicone sleeve, wherein said sleeve comprises:

an open end, a closed end opposite from the open end; and a vented mesh surface disposed at a top portion of the sleeve near the closed end, but not covering the closed end;

wherein a shape of the vented mesh surface is polygonal in a top view of the apparatus; and wherein the vented mesh surface allows direct fluid communication between an interior and an exterior of the imperforate sleeve.

2. The fingertip or toe tip protective apparatus of claim 1, wherein said imperforate silicon sleeve comprises:

an inner surface, wherein at least a portion of said inner surface possesses an adhesive.

3. The fingertip or toe tip protective apparatus of claim 1, wherein said silicone is a smooth and light weight material.

4. A fingertip or toe tip protective apparatus to protect a fingertip or a toe tip of a user, the protective apparatus comprising:

an imperforate silicone sleeve, wherein said sleeve comprises:

an open end disposed at a first end of the silicone sleeve to receive only one fingertip or one toe tip, a closed end disposed at a second end of the silicone sleeve opposite from the open end to contact a front-most portion of the one fingertip or the one toe tip when inserted within the silicone sleeve, an inner surface that possesses an adhesive, an outer surface; and a vented mesh surface disposed only at a top portion of the silicone sleeve near the closed end, but not covering the closed end;

wherein the vented mesh surface forms at least a portion of both the inner surface and the outer surface; and wherein the vented mesh surface allows direct fluid communication between the inner and the outer surface.

* * * * *